US006612580B1

(12) United States Patent
Weldon

(10) Patent No.: US 6,612,580 B1
(45) Date of Patent: Sep. 2, 2003

(54) METHOD OF PLAYING A MODIFIED BLACKJACK GAME

(76) Inventor: Russell G. Weldon, 156 Spring St., Glastonbury, CT (US) 06033

( * ) Notice: Subject to any disclaimer, the term of this patent is extended or adjusted under 35 U.S.C. 154(b) by 0 days.

(21) Appl. No.: 10/099,630

(22) Filed: Mar. 15, 2002

(51) Int. Cl.[7] ..... A63F 1/00
(52) U.S. Cl. ..... 273/292; 273/274
(58) Field of Search ..... 273/292, 274, 273/303, 304, 306, 309; 463/13

(56) References Cited

U.S. PATENT DOCUMENTS

| | | | | | |
|---|---|---|---|---|---|
| 5,098,107 | A | | 3/1992 | Boylan | 273/292 |
| 5,257,784 | A | | 11/1993 | Boylan | 273/138 R |
| 5,368,305 | A | * | 11/1994 | Rodda et al. | 273/292 |
| 5,549,300 | A | * | 8/1996 | Sardarian | 273/292 |
| 5,613,682 | A | * | 3/1997 | Otuzbiryan | 273/292 |
| 5,636,843 | A | * | 6/1997 | Roberts | 273/292 |
| 5,810,360 | A | * | 9/1998 | Srichayaporn | 273/292 |
| 5,853,325 | A | * | 12/1998 | Kadlic | 463/163 |
| 6,120,031 | A | * | 9/2000 | Adams | 273/292 |
| 6,170,828 | B1 | * | 1/2001 | Mostashari | 273/292 |
| 6,182,969 | B1 | * | 2/2001 | Green | 273/292 |
| 6,299,170 | B1 | * | 10/2001 | Yoseloff | 273/292 |
| 6,311,976 | B1 | * | 11/2001 | Yoseloff et al. | 273/138.2 |
| 6,322,078 | B1 | * | 11/2001 | Adams | 273/292 |
| 6,336,635 | B1 | | 1/2002 | Baer | 273/292 |
| 6,435,500 | B2 | * | 8/2002 | Gumina | 273/139 |
| 6,471,210 | B1 | * | 10/2002 | Goldman et al. | 273/292 |
| 6,494,454 | B2 | * | 12/2002 | Adams | 273/292 |

OTHER PUBLICATIONS

William R. Adams —Game with Reversable Wild indicia —May 16, 2002 —Pub No: US 2002/0056963 A1.*
Fardin Maxmillian Zahedi —Card Game And Method of Play —Nov. 15, 2001 —Pub No. US 2001/0040344 A1.*
Breeding et al. —Bet Withdrawal Casino Game With Wild Symbol —Mar. 7 A1, 2002 —Pub No. : US 2002/0027322.*

* cited by examiner

*Primary Examiner*—Benjamin H. Layno
*Assistant Examiner*—Dolores Collins

(57) ABSTRACT

A method of playing a modified blackjack game with a dealer and at least one player comprises providing a stack of playing cards including a plurality of decks, and selecting a card from among the stack of playing cards to serve as both a cut card and a wild card. The cut/wild card is not playable by the dealer. The cut/wild card is placed into generally the lower portion of the stack of playing cards. A value for the cut/wild card is selected by the player that is dealt the cut/wild card. The selected value may be taken from among the values associated with any one of the playing cards.

20 Claims, 1 Drawing Sheet

METHOD OF PLAYING A MODIFIED BLACKJACK GAME

FIELD OF THE INVENTION

This invention relates generally to games, and more particularly to a method of playing a variation to a blackjack card game.

BACKGROUND OF THE INVENTION

The game of "blackjack" or "twenty-one" is perhaps the most popular card game played in casinos throughout the United States. This game is typically played with a standard deck of playing cards containing fifty-two cards in four different suits. The object of the game is for each player to collect a number of cards in his or her hand whereby the total point value assigned to the cards in a player's hand is as close to possible to twenty-one without going over. Numbered cards (i.e., 2–10) are assigned a numerical value equal to their face value and face cards (i.e., king, queen and jack) are assigned a numerical value of ten points each. An ace card may be assigned either a point value of one or eleven—whichever value gives a more favorable hand to the player. If the point value in a player's hand exceeds twenty-one points, the player "busts" and is eliminated from further play until a winner is declared and the next hand is dealt.

Blackjack is typically played at tables that include a location for a dealer and up to seven additional players. Each player places a wager and, along with the dealer, initially receives two cards. In traditional blackjack, each player is playing against the dealer or "house". The dealer or house acts as the bank, paying all losses and collecting all winnings from the other players at the table. In order to win his or her wager, the cards in a player's hand must have a higher total point value than the total point value in the dealer's hand without going over twenty-one points.

During a player's turn, a player may elect to draw additional cards (i.e., take a "hit") or play only the cards currently held in his or her hand (i.e., "stand"). A player may continue to receive additional cards in order to try to reach a point total of twenty-one without exceeding twenty-one. It is not necessary to reach twenty-one points to win a game; it is only necessary to come closer to twenty-one points than the dealer. Since the dealer receives one of his two initial cards facedown (i.e., a "hole" card), the players know only half of the cards in the dealer's initial hand. This adds an element of uncertainty to a player's decision to take a hit or stand.

The risk of losing a hand by exceeding twenty-one points (i.e., "busting") by taking an additional card increases as the point total of the cards in the player's hand approaches twenty-one. A player increases the probability of beating the dealer's card total by selectively and strategically hitting or standing on a particular card situation. Under most house rules, the dealer must take a hit on any point total of sixteen or less and must stand on any point total of seventeen or more. Each player at the table who comes closer to a point total of twenty-one than the dealer without exceeding twenty-one wins his or her wager. Conversely, each player who "busts" or who does not achieve a higher point total than the dealer loses the hand and the corresponding wager for that hand. Even if the dealer also busts, the player still loses when the player busts.

A "blackjack" occurs when a player or the dealer receives an ace and a face card or ten. A blackjack by the dealer ends the game, causing all other players to lose their wagers. A blackjack for a player is the best possible hand for the player and beats the dealer unless the dealer also has a blackjack. Ties between the player and the dealer are a "push" and are typically won by the house. Players at a blackjack table will typically play multiple successive hands and players may enter and leave the game at any time between hands.

After all of the players have taken hits or have stood on their hand, the dealer stands or hits based on preestablished rules of the game. The conventional manner of play requires the dealer to take a hit whenever the dealer's hand is a "soft 17" count. However, in other casinos, the dealer stands on a soft 17 count. The term "soft" means that the ace is valued as a count of eleven, instead of as a count of one. A soft 17 occurs when the dealer has an ace and a six (or multiple cards that add up to six). The dealer will stand on soft 18s, soft 19s and soft 20s.

A drawback with traditional forms of blackjack is that the set point values of the cards may make the game somewhat predictable so as to eventually bore players after a few hands. Moreover, there is no incentive built-into the game for playing additional hands beyond other than the usual reasons of winning money or recouping money lost in previous wagers.

There is a need to provide a modified version of blackjack that generates additional unpredictability, excitement, and revenue for both players and casinos relative to traditional forms of blackjack.

SUMMARY OF THE INVENTION

A method of playing a modified blackjack game with a dealer and at least one player includes providing stack of playing cards including a plurality of decks, preferably five to seven decks. Each deck is preferably a conventional fifty-two card, four-suit collection. A card is selected from among the stack of playing cards to serve as both a cut card and a wild card. The cut/wild card, either a joker card or another designated card, is not playable by the dealer. The cut/wild card is placed either by a player or the dealer into a generally lower portion, preferably a lower third level, of the stack of playing cards. When a player is dealt the cut/wild card, the player may select a value for the cut/wild card from among the values associated with any one of the playing cards. Preferably, one cut/wild card is used for the stack of playing cards. Moreover, the cut/wild card is preferably prevented from being used by a player to double down or split. Further, the selection of the value for the cut/wild card is preferably limited to a value for making blackjack or "twenty-one" (i.e., automatic 21 by which the player would not win in a tie with the dealer's 21).

A first advantage of the present invention is that the anticipation of receiving a cut/wild card keeps players at the table longer for the benefit of the casinos.

A second advantage of the present invention is that players may tend to place larger wagers in anticipation of receiving the cut/wild card for the benefit of both players and the casinos.

A third advantage of the present invention is that the use of the cut/wild card adds fun to the game of blackjack.

A fourth advantage of the present invention is that the modified version of blackjack creates new marketing opportunities for casinos.

A fifth advantage of the present invention is that dealers do not need to learn an entirely new game.

A sixth advantage of the present invention is that players do not need to "work at it".

A seventh advantage of the present invention is that the modified game accentuates and updates the most popular table game in a gaming establishment.

An eighth advantage of the present invention is that the modified game adds revenue to the gaming establishment.

A ninth advantage of the present invention is that the gaming table and shoe need no modification—the casino could simply change the signage.

These and other advantages of the present invention will become more apparent in the light of the following detailed description and accompanying figures.

BRIEF DESCRIPTION OF THE DRAWINGS

The FIGURE is a flow diagram of a method of playing a modified game of blackjack in accordance with the present invention

DETAILED DESCRIPTION OF THE PREFERRED EMBODIMENT

Figure 1:
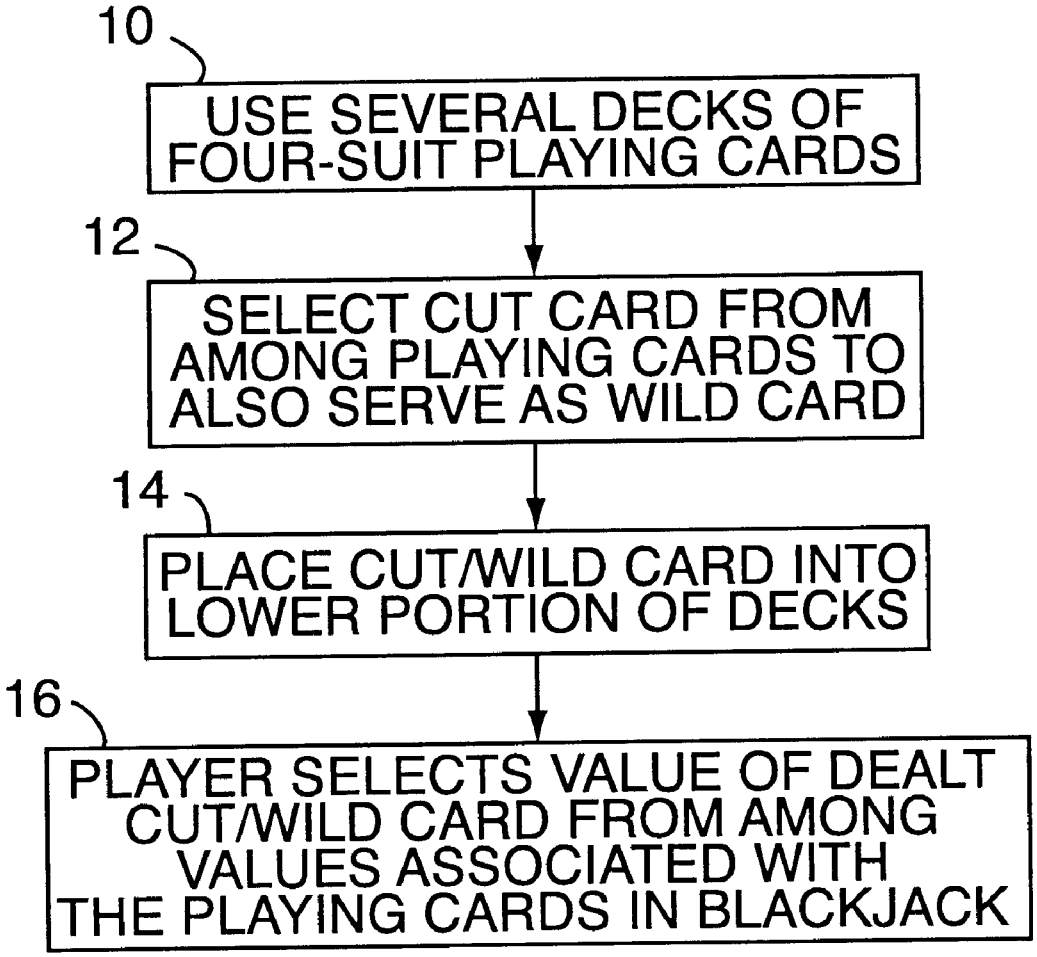

Turning to the FIGURE, a method of playing a modified blackjack card game in accordance with the present invention will be described with respect to a flow diagram. The flow diagram is not meant to illustrate the entire rules of the game of blackjack which are well-known, but rather to illustrate modifications to the game in accordance with the present invention.

The game is preferably played at a conventional blackjack table which seats the dealer and one to seven players. Typically, a betting square is printed on the table in front of each player's seat. A chip tray is located in front of the dealer. To the dealer's left is the deck or shoe for holding a stack of playing cards. To the dealer's right is a money drop slot where currency and tips in the form of betting chips are deposited.

With reference to step 10, a dealer, typically an employee at a casino, provides a stack of conventional playing cards including several decks (preferably five to seven decks) and places the decks into a deck shoe after the decks have been shuffled by the dealer and cut by one of the players. The use of multiple decks allows the dealer to deal more hands per hour to increase casino revenue, and to reduce the player advantage gained from card counting. Each deck preferably comprises a fifty-two card, four-suit collection. However, some cards in a deck may be removed from play, or other types of playing cards that can be ascribed point values may be substituted without departing from the scope of the present invention.

After the stack of playing cards have been shuffled, a card is selected from the stack in accordance with the present invention by either the dealer or the player to serve as both a cut card and a wild card (step 12). The cut/wild card is not played if received by the dealer, but rather is discarded and another card is dealt to the dealer's hand. Preferably, the cut/wild card is a card such as a joker, but the cut/wild card may be selected from among other face or number cards—or may be a card made specifically for this purpose and may bear a distinctive logo/design which may include the casino's logo—without departing from the scope of the present invention. Further in accordance with the present invention, the cut/wild card is then placed by the dealer into a lower portion of the stack of playing cards, preferably a lower third level of the stack (step 14). The cut/wild card may be inserted faceup in the stack or otherwise marked to distinguish it from other identical cards from the other decks used in the stack of playing cards.

Traditionally, wagers expressed in the form of gambling chips may be placed by the players in the respective betting squares. For example, the wager may be a minimum of $10.00 and a maximum of $200.00 with the payoff for blackjack or twenty-one being typically about 150% of the wager. Even money may be substituted for the 150% payoff as a tradeoff for the cut/wild card and/or in exchange for multiple cut/wild cards in a shoe. Once the wagers have been placed by the players, two cards are dealt by the dealer to the players one at a time in a direction from left to right around the table. Cards may be dealt either facedown or, more typically, faceup depending on the rules of the casino. The dealer receives one card facedown and one card faceup. Each player may then elect to receive no additional cards, or to receive one or more cards with the objective of exceeding the point total of the dealer's hand without exceeding twenty-one points.

A player typically may elect to "split" two cards of the same point value into two simultaneous hands in which the original wager will go with one card and the player will have to place an equal amount of chips in the betting box near the other card. The player is now playing two simultaneous hands as though they were regular hands. Typically, however, an exception is made when splitting two aces. In this case, the player only gets one card for each hand. If a split ace hand totals twenty-one, the split hand is typically paid 100% of the wager—not the regular 150% of the wager. Moreover, a player may typically double the wager (i.e., "double down") on a hand during play.

In accordance with the present invention, a player who eventually is dealt the cut/wild card (step 16) may select a point value for the cut/wild card from among the values associated with any one of the playing cards (i.e., from one to eleven points). The selected point value is selected in order to bring the point total of the hand to twenty-one. Preferably, the value for the cut/wild card is limited to making twenty-one points in the player's hand. In other words, the cut/wild card cannot be used by a player to double down, or to split or re-split the player's hand.

The method of playing modified blackjack in accordance with the present invention offers several benefits over traditional forms of blackjack. First, the anticipation of receiving a cut/wild card that is inserted in the lower portion of the stack of playing cards is an incentive to keep players at the blackjack table longer relative to the traditional game so as to benefit the casinos. Second, players may tend to place larger wagers in anticipation of receiving the cut/wild card, whereby such increased wagers can benefit both the player if he or she wins, or benefit the casino if the house wins. Third, the cut/wild card adds unpredictability and excitement to the game because of the increased winning probability to the person holding the cut/wild card. Fourth, the added excitement can create new marketing opportunities for casinos for drawing in additional players relative to traditional blackjack. Fifth, the modified version in accordance with the present invention does not require players to learn an entirely new game which might otherwise intimidate and scare players away from playing the game. Sixth, players do not need additional skill relative to traditional blackjack in order to play. Seventh, the draw of additional players, increased playing time and increased wagers can tend to generate additional revenue for the casinos. Eight, the gaming table and shoe need no modification casino could simply change the signage. Ninth, the modified version in accordance with the present invention provides marketing opportunities to the casino for such claims as, for example, "The Best Odds in Blackjack" or "Players Get the Best Odds in Blackjack" or "Improve Your Odds".

Although the invention has been shown and described in a preferred embodiment, it should be understood that numerous modifications can be made without departing from the spirit and scope of the present invention. Accordingly, the present invention has been shown and described by way of illustration rather than limitation.

What is claimed is:

1. A method of playing a modified blackjack game with a dealer and at least one player, comprising the steps of:

providing a stack of playing cards including a plurality of decks;

selecting a card from among the stack of playing cards to serve as both a cut card and a wild card, the cut/wild card not being playable by the dealer;

placing the cut/wild card into generally the lower portion of the stack of playing cards; and selecting a value for the cut/wild card by the player that is dealt the cut/wild card, the selected value being taken from among the values associated with any one of the playing cards.

2. A method as defined in claim 1, wherein the cut/wild card is a joker card.

3. A method as defined in claim 1, wherein the step of placing includes inserting the cut/wild card generally into a lower third level of the stack of playing cards.

4. A method as defined in claim 1, further including the step of preventing the cut/wild card from being used to double down.

5. A method as defined in claim 1, further including the step of preventing the cut/wild card from being used to split.

6. A method as defined in claim 1, further including the step of limiting one cut/wild card to the stack of playing cards.

7. A method as defined in claim 1, wherein the step of selecting a value for the cut/wild card is limited to a value for making blackjack or twenty-one.

8. A method as defined in claim 1, wherein the stack of playing cards includes five to seven decks.

9. A method as defined in claim 1, wherein the step of placing the cut/wild card includes inserting the cut/wild card faceup into the stack of playing cards.

10. A method as defined in claim 1, further including the step of placing a wager during play of each hand, the minimum amount of the wager being about $10.00.

11. A method as defined in claim 1, further including the step of placing a wager during play of each hand, the maximum amount of the wager being about $200.00.

12. A method of playing a modified blackjack game with a dealer and at least one player, comprising the steps of:

providing a stack of playing cards including about five to about seven decks;

selecting a card from among the stack of playing cards to serve as both a cut card and a wild card, the cut/wild card not being playable by the dealer;

placing the cut/wild card into generally a lower third level of the stack of playing cards; and selecting a value for the cut/wild card by the player that is dealt the cut/wild card, the selected value being taken from among the values associated with any one of the playing cards.

13. A method as defined in claim 12, wherein the cut/wild card is a joker card.

14. A method as defined in claim 12, further including the step of preventing the cut/wild card from being used to double down.

15. A method as defined in claim 12, further including the step of preventing the cut/wild card from being used to split.

16. A method as defined in claim 12, further including the step of limiting one cut/wild card to the stack of playing cards.

17. A method as defined in claim 12, wherein the step of selecting a value for the cut/wild card is limited to a value for making blackjack or twenty-one.

18. A method as defined in claim 12, wherein the step of placing the cut/wild card includes inserting the cut/wild card faceup into the stack of playing cards.

19. A method as defined in claim 12, further including the step of placing a wager during play of each hand, the minimum amount of the wager being about $10.00.

20. A method as defined in claim 12, further including the step of placing a wager during play of each hand, the maximum amount of the wager being about $200.00.

* * * * *